US007815519B2

(12) United States Patent
Bryant et al.

(10) Patent No.: US 7,815,519 B2
(45) **Date of Patent: *Oct. 19, 2010**

(54) GOLF CLUB HEAD AND METHOD OF MANUFACTURING

(75) Inventors: Leslie J. Bryant, Phoenix, AZ (US); Anthony D. Serrano, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/643,397

(22) Filed: Dec. 21, 2009

(65) Prior Publication Data

US 2010/0099510 A1 Apr. 22, 2010

Related U.S. Application Data

(63) Continuation of application No. 11/934,865, filed on Nov. 5, 2007, now Pat. No. 7,666,108.

(51) Int. Cl.
*A63B 53/04* (2006.01)

(52) U.S. Cl. ..... 473/288; 473/341; 473/342

(58) Field of Classification Search ..... 473/288, 473/342, 348, 349, 340–341, 325
See application file for complete search history.

(56) References Cited

U.S. PATENT DOCUMENTS

| | | | | |
|---|---|---|---|---|
| 5,275,413 | A * | 1/1994 | Sprague | 473/337 |
| 6,227,986 | B1 * | 5/2001 | Fisher | 473/342 |
| 6,860,820 | B2 * | 3/2005 | Specht | 473/312 |
| 7,037,211 | B1 * | 5/2006 | Kosovac | 473/304 |
| 7,416,494 | B2 * | 8/2008 | Edel | 473/288 |
| 7,442,129 | B2 * | 10/2008 | Bardha | 473/251 |
| 7,604,550 | B1 * | 10/2009 | Currie | 473/342 |
| 2004/0266548 | A1 * | 12/2004 | Cheng et al. | 473/342 |

* cited by examiner

*Primary Examiner*—Stephen L. Blau

(57) ABSTRACT

A golf club head is composed of a first body having mass concentrations at the heel and toe ends joined by a relatively thinner central web portion that is recessed from the front, top and rear surfaces of the club head. A second body member selected from a plurality of second body members composed of a relatively less dense material is temporarily attached to the web portion of the first body to form a face portion that extends from the sole to the top rail of the club as well as the central portion of the top rail.

20 Claims, 7 Drawing Sheets

GOLF CLUB HEAD AND METHOD OF MANUFACTURING

This application is a continuation application claiming priority of U.S. application Ser. No. 11/934,865 filed Nov. 5, 2007, now U.S. Pat. No. 7,666,108.

FIELD OF THE INVENTION

The present invention relates generally to golf equipment and in particular to putters with inserts.

DRAWINGS

DESCRIPTION

Figure 1:
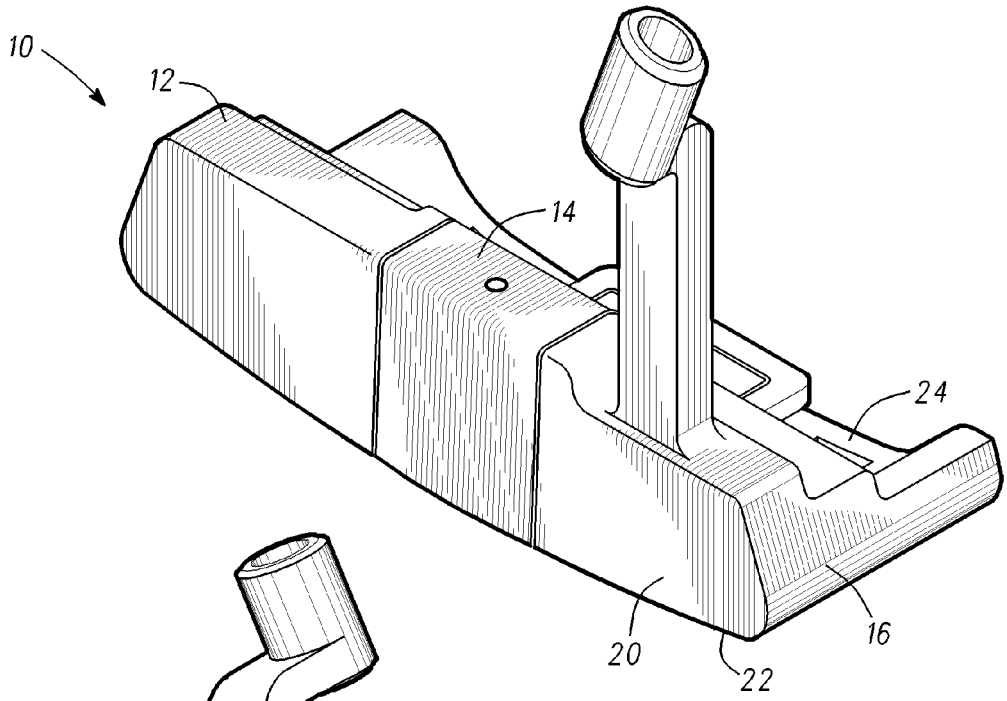
FIG. 1 is a front perspective view of an illustrative embodiment of putter head incorporating features of the present invention.
Figure 2:
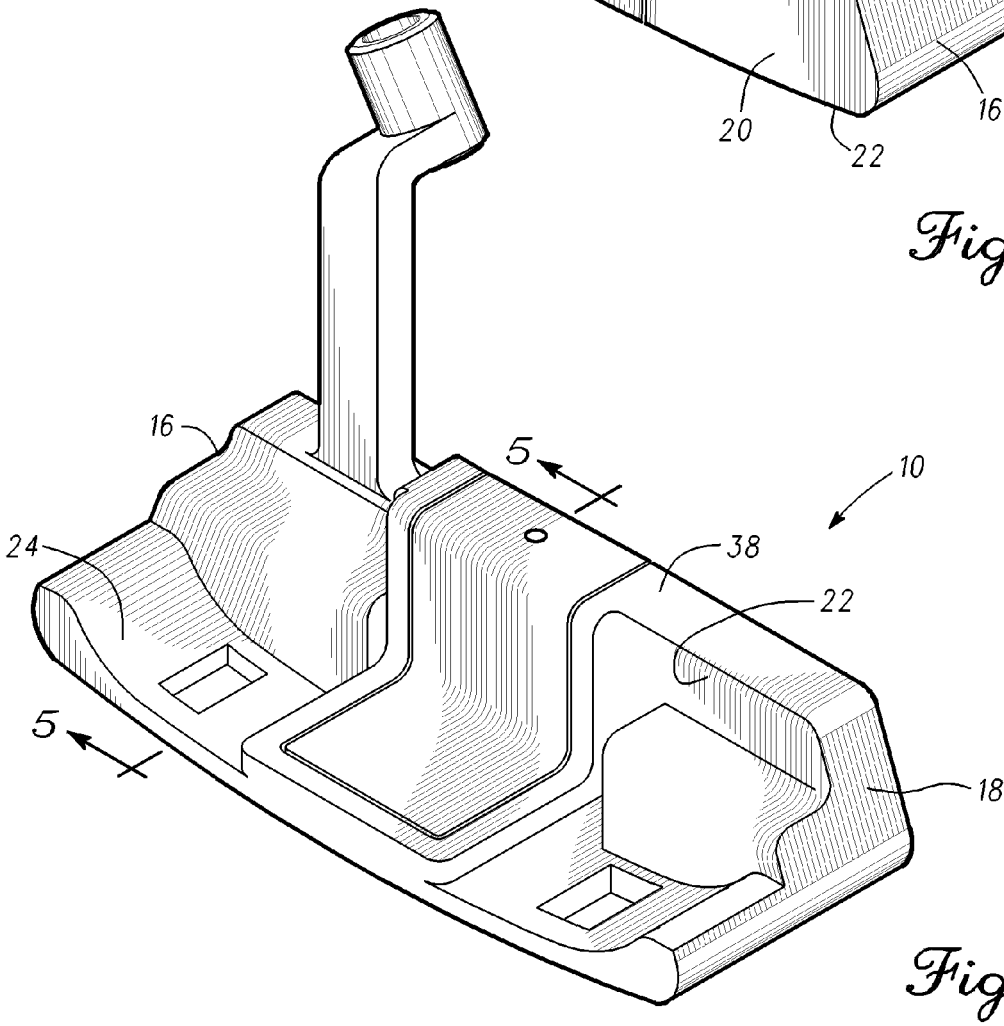
FIG. 2 is a rear perspective view of the putter head of FIG. 1.

With reference to FIGS. 1-6, a golf club head 10 comprises a first body member 12 and a second body member 14. For example, first body member 12 may be made of a metallic material such as stainless steel and/or any other suitable materials. First body member 12 includes a heel end 16, a toe end 18, a forward surface 20, a rearward surface 22 and a rear extension 24. Heel end 16 of first body member 12 further includes a hosel 26 having a hosel bore 28 adapted for receiving a golf club shaft (not shown).

Figure 3:
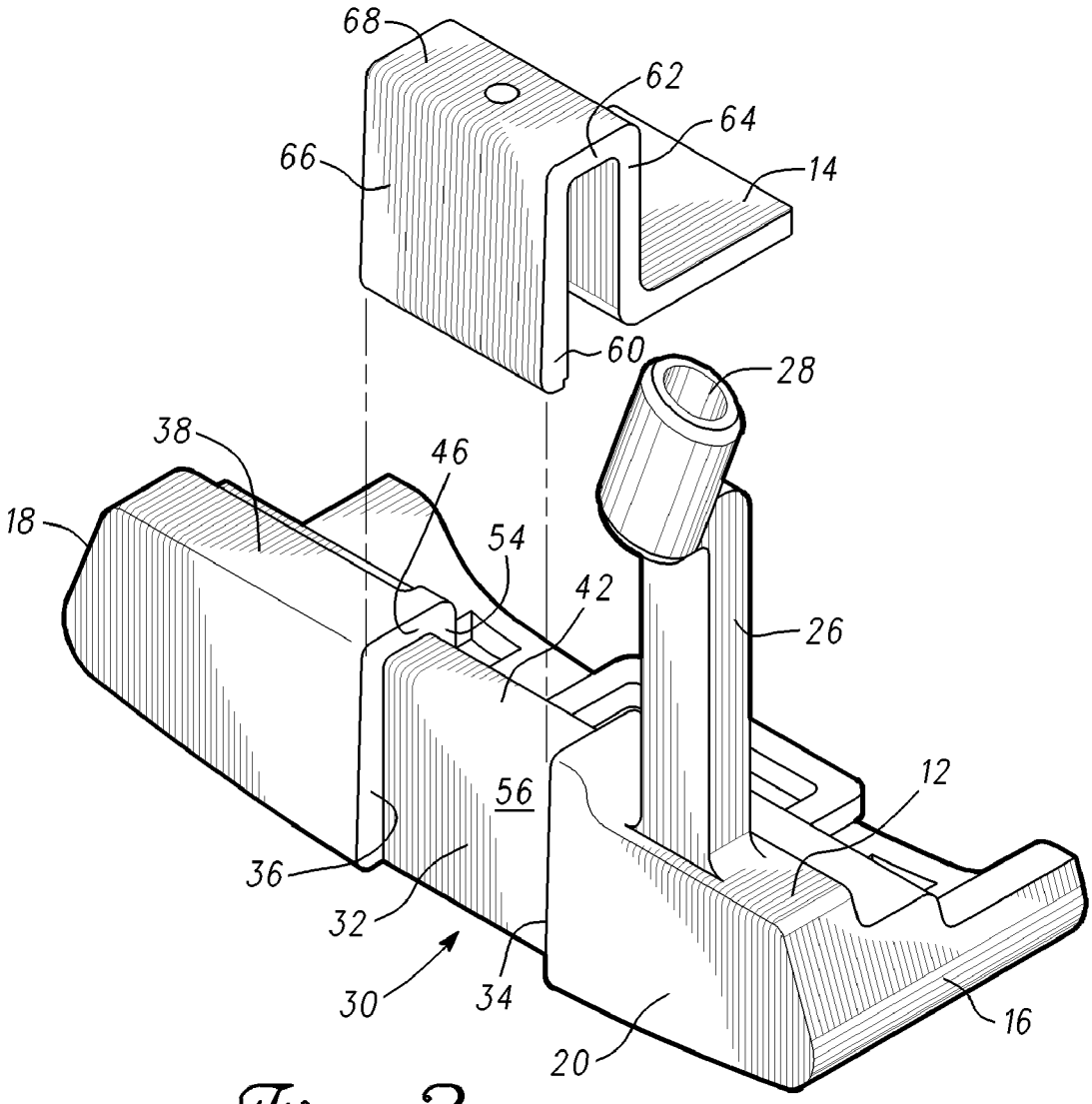
FIG. 3 is an exploded front perspective view of the putter head of FIG. 1.
Figure 4:
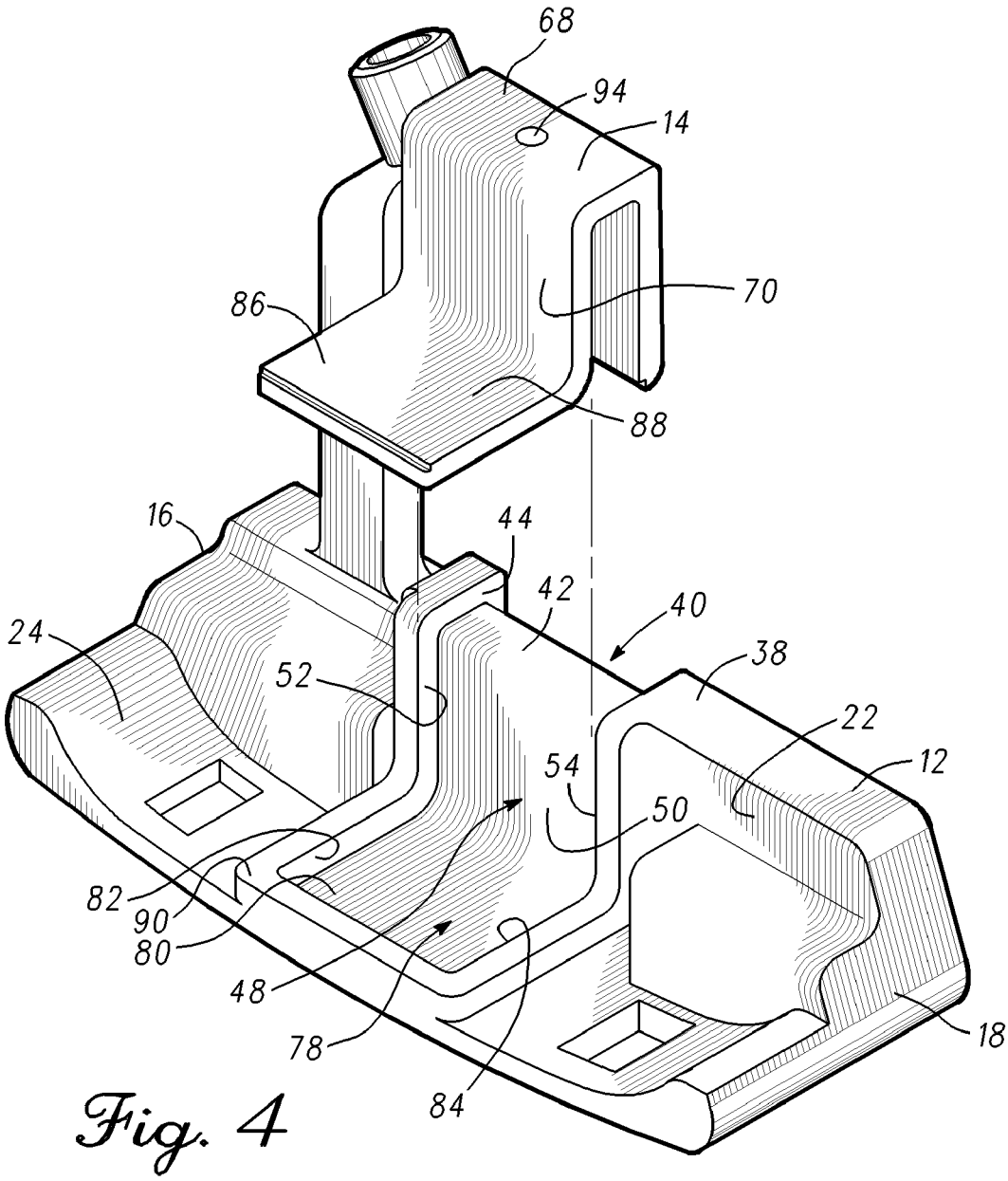
FIG. 4 is a rear perspective view of the putter head of FIG. 1.

With particular reference to FIGS. 3 and 4, forward surface 20 of first body member 12 includes a recessed portion 30 having a recessed surface 32, a near side wall 34 and a far side wall 36. Top rail 38 of first body 12 also includes a recessed portion 40 defined by a recessed surface 42, a near side wall 44 and a far side wall 46.

Rearward surface 22 of first body member 12 also includes a recessed portion 48 defined by a recessed surface 50, a near side wall 52 and a far side wall 54. Recessed surfaces 32, 42 and 50 are of equal depth below front surface 20, top rail 38 and rearward surface 22, respectively. Therefore recessed surfaces 32, 42 and 50 cooperate to form a relatively thin web portion 56 joining the relatively thicker mass concentrations at heel end 16 and toe end 18 of first body member 12. For example, the depth of the recessed portions can be from 0.100 to 0.250 inches. In one example, web portion 56 may have a thickness between recessed surfaces 32 and 50 of from 0.200 to 0.450 inches.

Second body member 14 is attached to first body member 12 as discussed more fully hereinafter. Second body member 14 has a substantially upright front flange portion 60 having a thickness equal to the depth of recessed portion 30, a horizontally extending flange portion 62 having a thickness equal to the depth of recessed portion 40 and a rear flange portion 64 having a thickness equal to the depth of recessed portion 48. Accordingly, when second body member 14 is placed over web portion 56, forward surface 66 of second body member 14 is substantially coplanar with forward surface 20 of first body member 12. Similarly, the upper surface of intermediate portion 68 and the outer surface of rear portion 70 of second body member 14 are coplanar with their respective adjoining top rail 38 and rearward surfaces 22 of first body member 12.

In one example, second body member 14 comprises a relatively lower density material such as a polymer. In another example, second body member 14 is an injection molded thermoplastic such as thermoplastic polyurethane or cellulose acetate propionate. In particular, second body member 14 may be formed of a thermoplastic polyurethane having a hardness of between 50 Shore D and 80 Shore D. Alternatively, second body member 14 may be formed of thermoplastic polyurethane having a hardness of approximately 72 Shore D. The methods and apparatus described herein are not limited in this regard.

As can be determined from the foregoing, providing a thin web portion 56 joining the relatively more massive heel and toe portions of first body member 12 increases the perimeter weighting of the club head over other insert putters in which the insert is poured or placed into a cavity formed in the metallic portion of the club head. Moreover, because second body member 14 extends across the full height of golf club head 10 from sole 72 to top rail 38, there is no metallic rim surrounding nonmetallic second body member 14. Accordingly, only second body member 14 will contact the golf ball even if the ball is struck high or is struck low, thereby leading to more consistent performance of the putter in use.

In the illustrative embodiment of FIGS. 1-6, second body member 14 is temporarily attached to first body. As used herein, temporarily attached, means that second body member 14 may be removed (e.g. by prying) from first body member 12 without destroying second body member 14 or damaging first body member 12 as would be the case if second body member 14 were removed by sawing, drilling, milling, etc. The means for temporarily attaching second body member 14 to first body member 12 are also integral either to second body member 14 or first body member 12, As used herein, "integral" means that the attachments are either imbedded in or cast as feature(s) on second body member 14 or first body member 12 or are otherwise permanently affixed to second body member 14 or first body member 12 as opposed to threaded fasteners, rivets and other separate fasteners.

Figure 7:
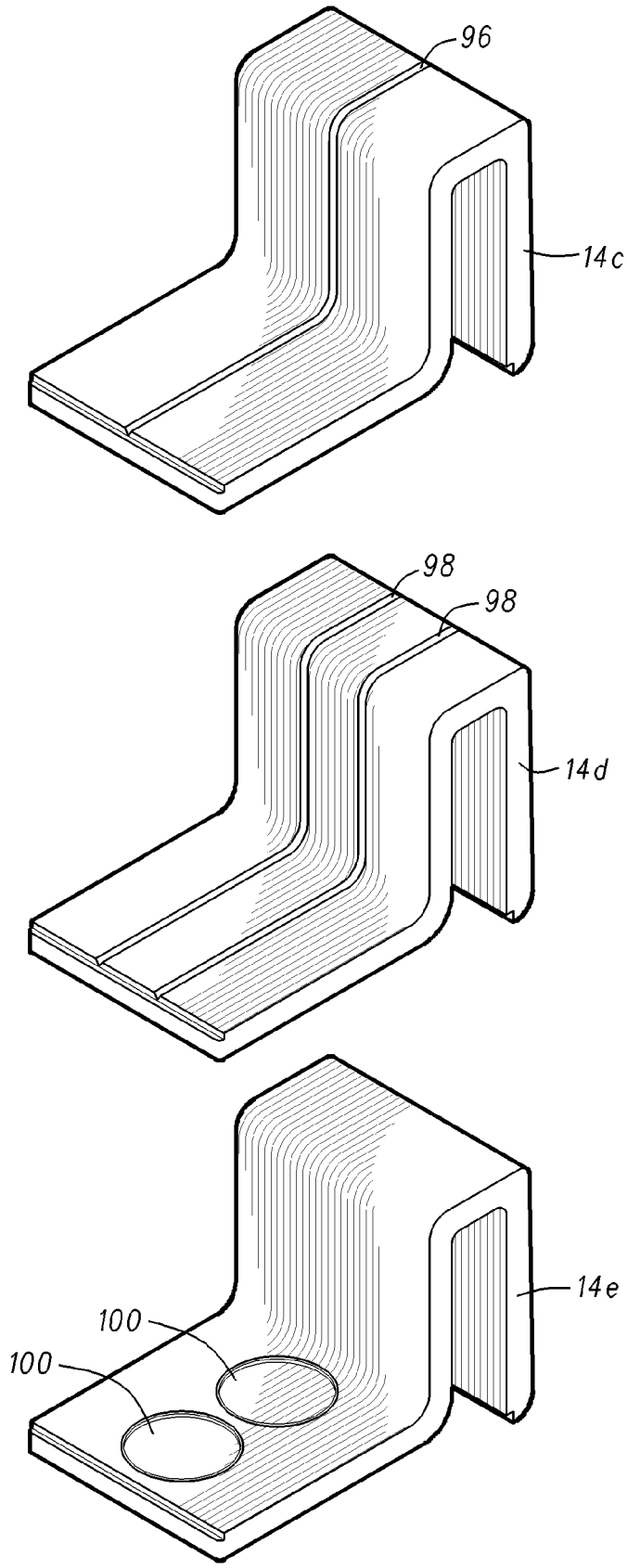
FIG. 7 is a rear perspective view of a plurality of second body members associated with the putter head of FIG. 1.

In the illustrative embodiment, second body member 14 is retained to first body member 12 by one or more detents 92 formed on first body member 12, which engage corresponding recesses in second body member 14, either alone or in combination with adhesive tape, which prevents second body member 14 rattling against first body member 12 when the club is struck. This feature allows one of a plurality of second body members 14*c*, 14*d*, 14*e* as shown in FIG. 7 to be affixed to a given first body member, either by the manufacturer or the user may select one of a plurality of second body members 14*c*, 14*d*, 14*e* supplied as a kit to enable post-sale interchangeability of second body members 14*c*, 14*d*, 14*e* to suit the user's taste. The plurality of second body members 14*c*, 14*d*, 14*e*, may be made of different materials to provide a different feel or sound to suit the user's taste. Additionally, since some users prefer a traditional alignment aid such as a small circular dot 94 on the top rail of the club, while other users prefer more elaborate alignment aids, such as single lines 96, parallel lines 98, large circles 100, or chevrons, etc. and may prefer different colored second body members to contrast with the color of first body member 12, the plurality of second body members 14*c*, 14*d*, 14*e*, may have different colors and/or different alignment indicia appearing on their respective upper surfaces.

Figure 8:
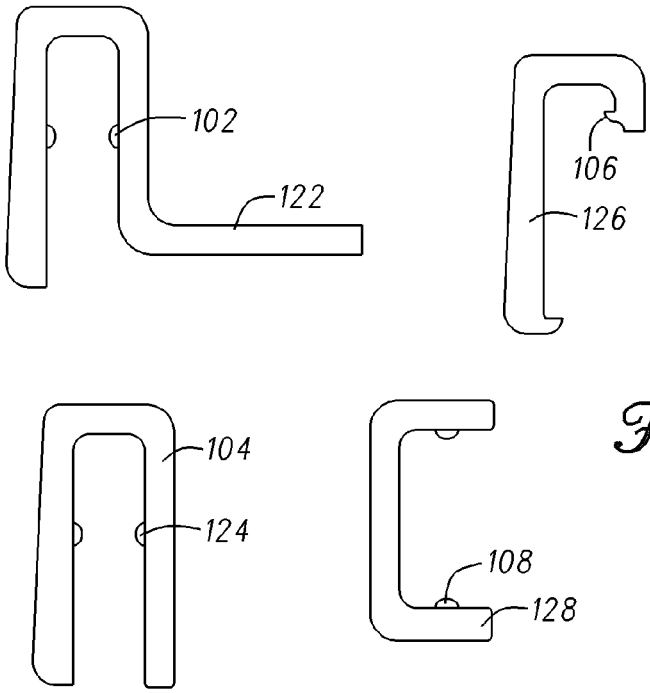
FIG. 8 is a side view of alternative embodiments of a second body member incorporating features of the present invention.

Alternatively, as shown in FIG. 8, second body member 122 may be retained to first body member by detents 102 formed on the surface of second body member 122, which engage corresponding recesses formed in first body member 12. Additionally, although the second body member may be formed with a cross-section in the shape of a question mark as with second body member 122, second body member is not limited to question mark shapes, but may have a U-shaped cross section as with second body 124, which includes detents 104, an L-shaped cross section as with second body 126, which includes a hook-shaped detent 106, a C-shaped cross section as with second body 128, which includes detents 108, or any other suitable cross section and integral means for temporarily attaching a second body to a first body.

In the illustrative embodiment, rear extension 24 of first body member 12 also includes a recessed portion 78 defined by a recessed surface 80, a near side wall 82 and a far side wall 84. Second body member 14 has a corresponding rear projection 86 having a thickness equal to the depth of recessed portion 78 so that when second body member is in place, top surface 88 is flush with upper surface 90 of rear extension 24. The upper surface of intermediate portion 68 and top surface of rear projection 88 of second body member 14 are inherently contrasting in color and/or surface finish compared to first body member 12. Accordingly, the surfaces cooperate to form a natural alignment aid to assist the golfer with aligning forward surface 66 of second body member 14 with the golf ball to be putted.

Figure 5:
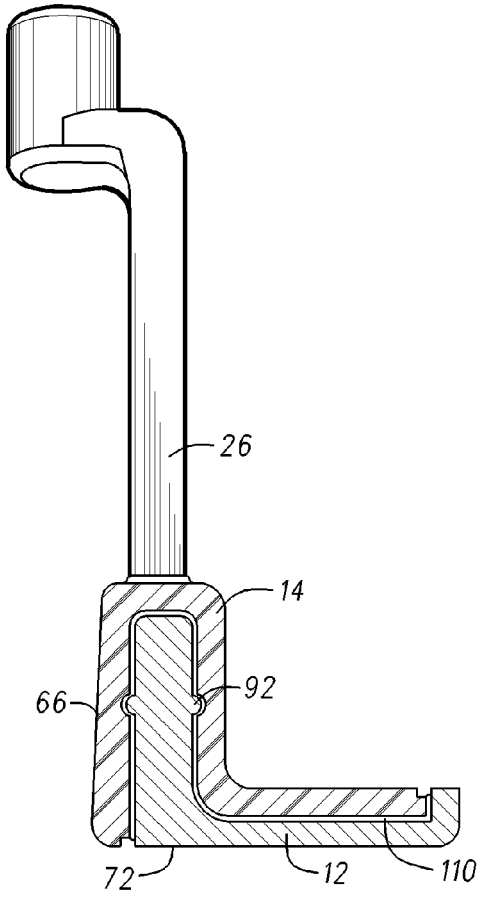
FIG. 5 is a cross-sectional view of the putter head of FIG. 2 taken along line 5-5.
Figure 6:
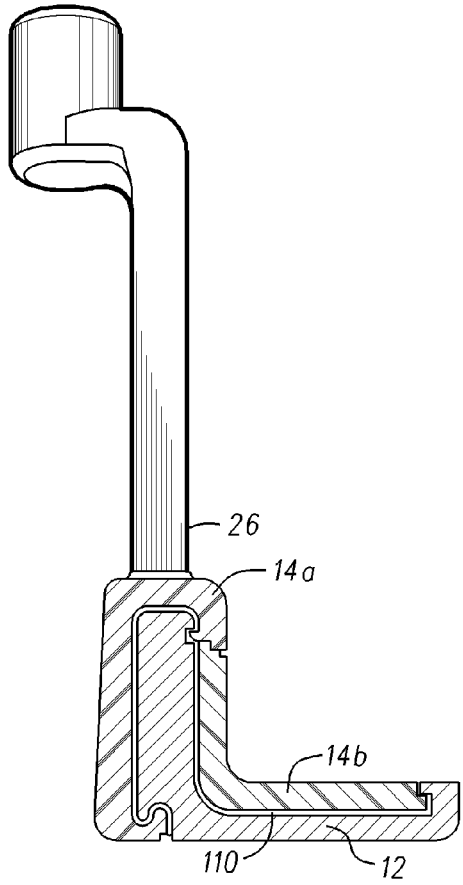
FIG. 6 is a cross-sectional view of an alternative embodiment of a putter head incorporating features of the present invention.

As shown in FIG. 5, in the illustrative embodiment second body member 14 is a unitary member attached to first body member 12 by a combination of detents and a conventional adhesive such as a thermoset epoxy 110 disposed in the gap between first body member 12 and second body member 14. Alternatively, as shown in FIG. 6, second body member 14 is composed of two parts 14*a* and 14*b* which interlock mechanically with first body member 12 to retain second body members 14*a* and 14*b* either alone or as supplemented by adhesive layer 110.

As noted above, second body member 14 may be temporarily coupled to first body member 12 with detents to allow interchangeability of the alignment indicia and/or color associated with golf club head 10. Alternatively, second body member 14 may be temporarily coupled to first body member 12 via one or more alternative temporary attachment devices such as hook and loop fasteners or magnetic devices. In an illustrative embodiment, first body member 12 is made of a ferrous material and second body member 14 includes one or more magnetic devices embedded within second body member 14. Alternatively, first body member is made of a non ferrous material and first body member may have imbedded magnets or imbedded ferrous targets to attract the magnets imbedded in second body member 14. The methods, apparatus, and articles of manufacture described herein are not limited in this regard.

Figure 9:
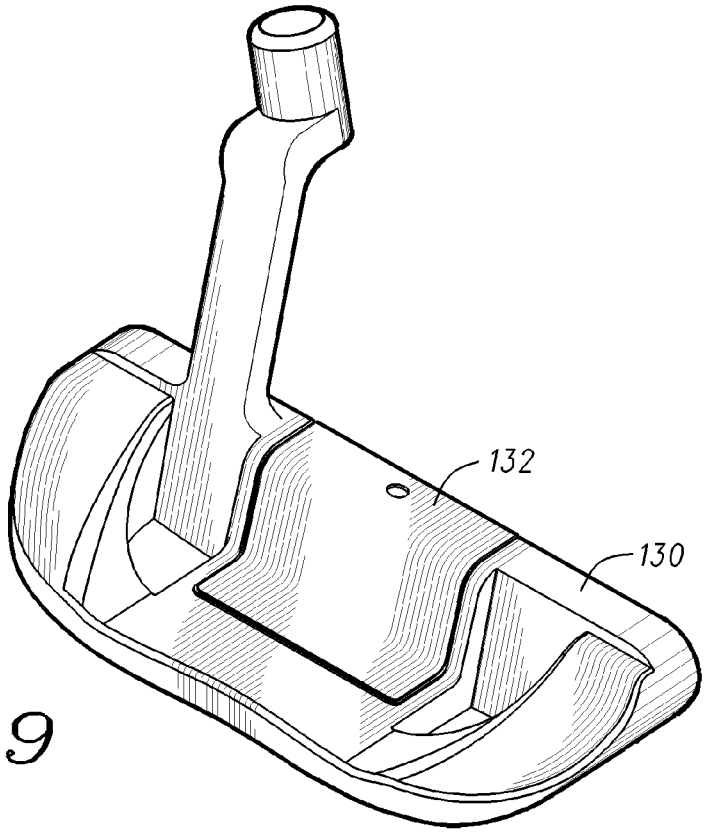
FIG. 9 is a rear perspective view of an alternative embodiment of a first body member.
Figure 10:
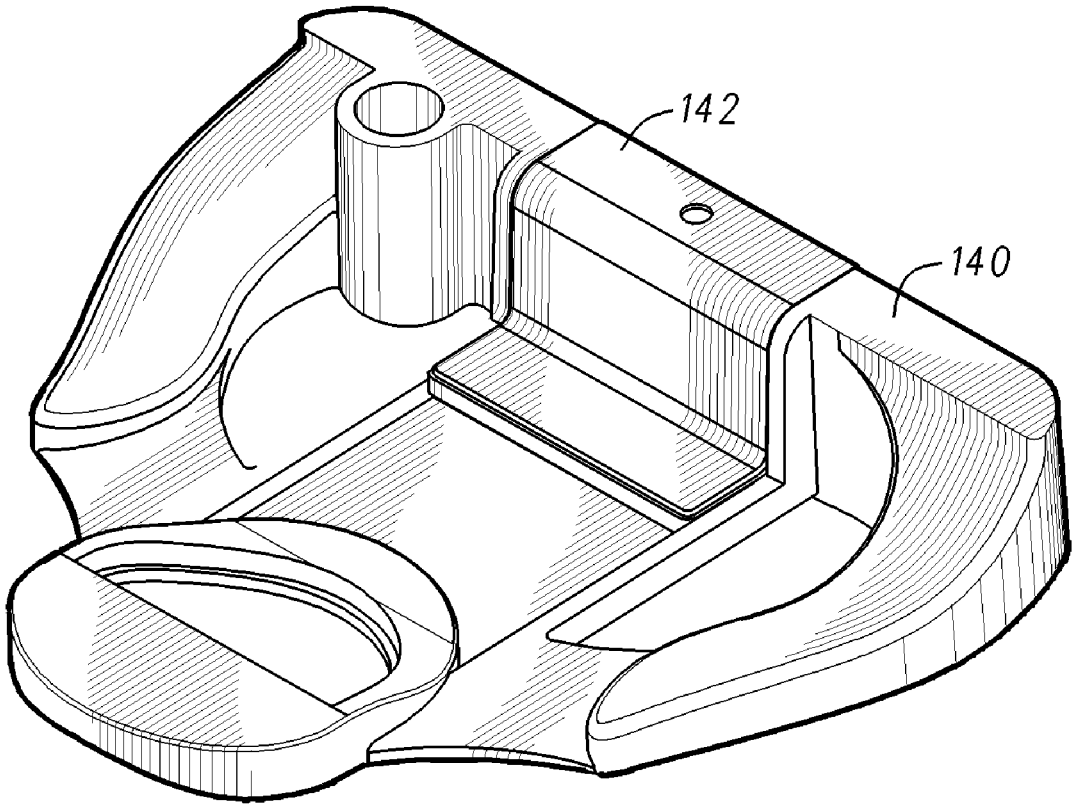
FIG. 10 is a rear perspective view of an additional alternative embodiment of a first body member.

Although the above examples may describe and depict first and second body members with particular configurations, shapes, sizes, and/or materials, the methods, apparatus, and articles of manufacture described herein may include first and second body members with other suitable configurations, shapes, sizes, and/or materials, such as first body 130 together with second body member 132 as shown in FIG. 9, and first body 140 together with second body 142. Further while the above examples may describe and depict putter-type club head, the methods, apparatus, and articles of manufacture described herein may be applicable to driver-type club heads, fairway wood-type club heads, hybrid-type club heads, iron-type club heads, and/or other suitable types of golf club heads. In addition, the methods, apparatus, and articles of manufacture may be applicable other sport equipment (e.g., a baseball bat, a hockey stick, etc.) or pieces of hardware to strike an object (e.g., a hammer, a mallet, etc.). The methods, apparatus, and articles of manufacture described herein are not limited in this regard.

Although certain illustrative embodiments and methods have been disclosed herein, it will be apparent from the foregoing disclosure to those skilled in the art that variations and modifications of such embodiments and methods may be made without departing from the spirit and scope of the invention. Accordingly, it is intended that the invention should be limited only to extent required by the appended claims and the rules and principals of applicable law.

What is claimed is:

1. An insert for temporary attachment to a body portion of a golf club head, the body portion composed of a first material having a heel end, a toe end, a sole, a forward surface, an upper surface, and a rear surface, wherein the forward surface of the body portion includes raised portions proximal the heel and toe ends and a first recessed portion intermediate the heel and toe ends, the first recessed portion being defined by a first near side wall adjacent the heel end, a first far side wall adjacent the toe end and a first recessed surface extending between the first near side wall and the first far side wall, the upper surface of the body portion comprising raised portions proximal the heel and toe ends and a second recessed portion intermediate the heel and toe ends, the second recessed portion being defined by a second near side wall adjacent the heel end, a second far side wall adjacent the toe end and a second recessed surface extending between the second near side wall and the second far side wall; the insert comprising:

an insert body member formed of a second material, the insert body member being temporarily attached to the body portion with an inner surface of the insert body member disposed adjacent the first and second recessed surfaces, the insert body member having a vertical flange portion with an outer surface extending between the raised portions of the forward surface and a horizontal flange portion extending between the raised portions of the upper surface of the body portion, the insert body member cooperating with the body portion to form a substantially continuous, substantially flat front striking surface and a substantially continuous top rail surface.

2. The insert of claim 1, wherein:

the first material is more dense than the second material.

3. The insert of claim 1, wherein:

the insert body member is selected from a plurality of insert body members having different alignment markings applied thereto.

4. The insert of claim 1, wherein:

the insert body member is selected from a plurality of insert body members formed of different materials.

5. The insert of claim 1, wherein:

the insert body member is selected from a plurality of different colored insert body members.

6. The insert of claim 1, wherein:

the insert body member is temporarily attached to the body portion by at least one integral fastener.

7. The insert of claim 6, wherein:

the at least one integral fastener comprise a plurality of projections and corresponding recesses formed in the insert body member and the body portion.

8. The insert of claim 6, wherein:

the at least one integral fastener comprise a plurality of magnets embedded in the insert body member.

9. The insert of claim 1, wherein:

the insert body member has a substantially vertical rear flange portion spaced apart from the vertical flange portion, the rear flange portion cooperating with a rear surface of the body portion to form a substantially continuous rear face disposed rearward of the front striking surface.

10. The insert of claim 9, wherein:

the insert body member has a substantially horizontally rearward projecting flange, the rearward projecting flange cooperating with a rear extension of the golf club head to form a substantially continuous horizontal rear surface disposed rearward of the rear surface of the body portion.

11. The insert of claim 1, wherein:

the vertical flange portion of the insert body member extends to the sole of the body portion.

12. An insert for temporary attachment to a golf club head made of a first material comprising a face and a top rail each of the face and the top rail having raised portions proximate to a heel end and a toe end of the golf club head and recesses intermediate the raised portions in the face and the top rail, each of the recesses having a width dimension and a depth dimension, the insert comprising:

a body portion made from a second material, the body portion comprising a first vertical flange portion and a first horizontal flange portion, the first vertical flange portion having width and depth dimensions substantially equal to the width and depth dimensions of the recess intermediate the raised portions of the face and the first horizontal flange portion having width and depth dimensions substantially equal to the width and depth dimensions of the recess intermediate the raised portions of the top rail, the body portion further comprising at least one integral fastener for temporarily attaching the body portion to the golf club head.

13. The insert of claim 12, further comprising:

a second vertical flange portion having a free end and a fixed end attached to the horizontal flange, the second vertical flange portion arranged in a parallel, spaced-apart configuration from the first vertical flange portion, the second vertical flange portion forming a rear surface of the golf club head when the body portion is temporarily attached to the golf club head.

14. The insert of claim 13, further comprising:

a second horizontal flange portion having a free end and a fixed end attached to the free end of the second vertical flange portion, the second horizontal flange portion extending horizontally away from the first and second vertical flange portions, whereby the body portion is substantially "question mark" shaped in cross section viewed from the heel end toward the toe end.

15. The insert of claim 12, wherein:

the at least one integral fastener comprises a plurality of detents for engaging corresponding recesses in one of the body portion and the golf club head.

16. The insert of claim 12, wherein:

The at least one integral fastener comprises at least one magnet embedded in one of the body portion and the golf club head.

17. The insert of claim 12, wherein:

the body portion is selected from a plurality bodies formed of different materials.

18. An insert for attachment to a golf club head made of a first material comprising a face and a top rail each having raised portions proximal a heel end and a toe end thereof and recesses intermediate the raised portions in the face, top rail and rear surface, the recesses each having a width dimension and a depth dimension, the insert comprising:

a body composed of a second material, the body comprising a front vertical flange portion, a rear flange portion and a horizontal flange portion disposed between the front vertical flange portion and the rear flange portion, the front vertical flange portion having width and depth dimensions substantially equal to the width and depth dimensions of the recess intermediate the raised portions of the face, the rear flange portion having width and depth dimensions substantially equal to the width and depth dimension of the recess intermediate the raised portions of the rear surface, and the horizontal flange portion having width and depth dimensions substantially equal to the width and depth dimensions of the recess intermediate the raised portions of the top rail, wherein the body further comprises a rearwardly extending flange portion whereby the body is substantially "question mark" shaped in cross section viewed from the heel end toward the toe end.

19. The insert of claim 18, wherein:

the body is selected from a plurality of bodies formed of different materials.

20. A removable insert comprising:

a first portion comprising a first vertical flange having width and depth dimensions substantially equal to width and depth dimensions of a face recess formed in a face of a body forming a golf club head, the face recess being intermediate a raised portion proximate to a heel end of the face of the body and a raised portion proximate to a toe end of the face of the body, and a second portion comprising a first horizontal flange portion having width and depth dimensions substantially equal to width and depth dimensions of a top rail recess formed in a top rail of the body, the top rail recess being intermediate a raised portion proximate to a heel end of the top rail of the body and a raised portion proximate to a toe end of the top rail of the body;

a third portion comprising a second vertical flange extending from the first horizontal flange substantially parallel to the first vertical flange, the second vertical flange having width and depth dimensions substantially equal to width and depth dimensions of rear wall recess formed in a rear wall of the body, the rear wall recess being intermediate a raised portion proximate to a heel end of the rear wall and a raised portion proximate to a toe end of the rear wall of the body;

a fourth portion comprising a second horizontal flange extending from the second vertical flange substantially parallel to the first horizontal flange, the second horizontal flange having width and depth dimensions substantially equal to width and depth dimensions of rear extension recess formed in a rear extension of the body, the rear extension recess being intermediate a raised portion proximate to heel end of the rear extension and a raised portion proximate to a toe end of the rear extension of the body; and at least one fastener integrally formed in the removable insert for temporarily attaching the removable insert to the body.

* * * * *